US012458152B2

(12) United States Patent
Chambers

(10) Patent No.: US 12,458,152 B2
(45) **Date of Patent: *Nov. 4, 2025**

(54) THREE DIMENSIONAL MATTRESS SYSTEM

(71) Applicant: George Allen Chambers, Kingwood, TX (US)

(72) Inventor: George Allen Chambers, Kingwood, TX (US)

( * ) Notice: Subject to any disclaimer, the term of this patent is extended or adjusted under 35 U.S.C. 154(b) by 268 days.

This patent is subject to a terminal disclaimer.

(21) Appl. No.: 18/136,617

(22) Filed: Apr. 19, 2023

(65) Prior Publication Data

US 2023/0248155 A1 Aug. 10, 2023

Related U.S. Application Data

(63) Continuation-in-part of application No. PCT/IB2021/059287, filed on Oct. 11, 2021.
(Continued)

(51) Int. Cl.
*A47C 31/12* (2006.01)
*A47C 19/02* (2006.01)
(Continued)

(52) U.S. Cl.
CPC ..... *A47C 31/123* (2013.01); *A47C 19/025* (2013.01); *A47C 21/044* (2013.01);
(Continued)

(58) Field of Classification Search
CPC ... A47C 31/123; A47C 21/044; A47C 23/002; A47C 19/025; A47C 27/086;
(Continued)

(56) References Cited

U.S. PATENT DOCUMENTS 4,163,297 A 8/1979 Neumark
4,862,539 A * 9/1989 Bokich ..... A47C 27/086 5/691
(Continued)

FOREIGN PATENT DOCUMENTS

CN 209932129 1/2020
JP 63-317152 12/1988
(Continued)

*Primary Examiner* — Matthew Troutman
*Assistant Examiner* — Alison L Labarge
(74) *Attorney, Agent, or Firm* — PATENTFILE, LLC; Bradley C. Fach; Steven R. Kick

(57) ABSTRACT

A three dimensional mattress system is provided which may be configured to provide three dimensional body support to a user. In some embodiments, the system may include a rigid frame, and a frame cavity, in which the frame cavity is open at its highest elevation. A plurality of pillows may be contained within the frame cavity. At least a portion of the plurality of pillows may be coverless, and at least a portion of the pillows in the plurality of pillows are not physically attached to one another and are substantially independent of one another such that they can move freely within the frame cavity. The plurality of pillows may form a first body support area for supporting a first portion of the user, and a support unit may form a second body support area for supporting a second portion of the user.

19 Claims, 12 Drawing Sheets

Related U.S. Application Data

(60) Provisional application No. 63/104,953, filed on Oct. 23, 2020.

(51) Int. Cl.
*A47C 21/04* (2006.01)
*A47C 23/00* (2006.01)
*A47G 9/10* (2006.01)

(52) U.S. Cl.
CPC ..... *A47C 21/048* (2013.01); *A47C 23/002* (2013.01); *A47G 9/10* (2013.01)

(58) Field of Classification Search
CPC ..... A47C 27/14; A47C 27/082; A47C 27/083; A61G 7/05738

See application file for complete search history.

(56) References Cited

U.S. PATENT DOCUMENTS

| | | | | |
|---|---|---|---|---|
| 8,584,286 | B2 | 11/2013 | Call | |
| 2004/0117911 | A1* | 6/2004 | Rapisarda | A47C 27/12 5/655.4 |
| 2008/0000030 | A1 | 1/2008 | Wang | |
| 2015/0238123 | A1 | 8/2015 | Yakam et al. | |
| 2015/0289666 | A1* | 10/2015 | Chandler | A47C 27/082 5/423 |
| 2015/0296993 | A1* | 10/2015 | Boyd | A47C 27/001 5/724 |
| 2017/0156507 | A1* | 6/2017 | Rawls-Meehan | A47C 27/148 |
| 2020/0170417 | A1 | 6/2020 | Alletto et al. | |
| 2021/0120957 | A1* | 4/2021 | Amiri | B68G 13/00 |

FOREIGN PATENT DOCUMENTS

| | | | |
|---|---|---|---|
| JP | 11-056537 | 3/1999 | |
| JP | 2005-342225 | 12/2005 | |
| JP | 2010253140 | 11/2010 | |
| KR | 20210060053 A * | 5/2021 | A47C 27/00 |

* cited by examiner

THREE DIMENSIONAL MATTRESS SYSTEM

CROSS REFERENCE TO RELATED APPLICATIONS

This application is a continuation-in-part of international patent application no. PCT/IB2021/059287 filed on Oct. 11, 2021 which in turn claims the benefit and the filing date of U.S. Provisional Application No. 63/104,953, filed on Oct. 23, 2020, entitled "Three dimensional mattress system with environmental control", the entire disclosures of which are incorporated by reference herein.

FIELD OF THE INVENTION

This patent specification relates to the field of devices and systems for supporting a living body. More specifically, this patent specification relates to a system for providing three dimensional support to a living body, such as for sleep and other activities.

BACKGROUND

People have been using two dimensional body support devices and systems for sleep and other activities since time immemorial. These two dimensional body support devices and systems include conventional sleeping mats, mattresses stuffed with various materials, innerspring mattresses, foam mattresses, waterbeds, etc. At best, these two dimensional body support devices and systems provide a resilient surface which minimizes pressure points on the body, at worst, these two dimensional body support devices and systems simply offer a layer of padding between the user's body and the ground or floor. In small part or in larger part a user's sleep quality and daytime performance is affected by the support device and system that they sleep on. Therefore, a need exists for novel body support devices and systems which provide increased comfort and support over existing body support devices and systems. A further need exists for novel body support devices and systems which are not limited to only supporting a user's body in two dimensions. There is also a need for novel body support devices and systems which offer a customizable three dimensional body support experience.

BRIEF SUMMARY OF THE INVENTION

A three dimensional mattress system is provided which may be configured to provide three dimensional body support to a user. In some embodiments, the system may include a rigid frame that may form a frame cavity. A plurality of pillows may be positioned within the frame cavity, so that a user may be supported by the plurality of pillows. Preferably, the plurality of pillows is entirely or at least partially "coverless," meaning not enclosed in a cover, bag, or membrane such that a user's body can sink down between and among the plurality of pillows, thereby providing a customizable three dimensional body support experience. As used herein, "cover" or "coverless" is used to refer to the presence or absence of a membrane, fabric, or bag enclosing a plurality of pillows, and not to a conventional individual pillowcase.

In some embodiments, the system may include a rigid frame, and a frame cavity, in which the frame cavity is open at its highest elevation. A plurality of pillows may be contained within the frame cavity. At least a portion of the plurality of pillows may be coverless, and at least a portion of the pillows in the plurality of pillows are not physically attached to one another and are substantially independent of one another such that they can move freely within the frame cavity. The plurality of pillows may form a first body support area for supporting a first portion of the user, and a support unit may form a second body support area for supporting a second portion of the user.

In further embodiments, the system may include a rigid frame forming a frame cavity. In some embodiments, one or more parts of the rigid frame may be adjustable, either horizontally or vertically, using one or more of slider hardware, hinges, clasps, locks, motors, etc. A support grid may be positioned within the frame cavity. One or more temperature regulators may be positioned above and/or below the support grid. A plurality of pillows may be positioned within the frame cavity above the support grid, and a user may be supported above the support grid by the plurality of pillows. One or more air moving devices may be configured to move air to the frame through the plurality of pillows, and one or more air filters may be configured to filter air moved by the air moving devices.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
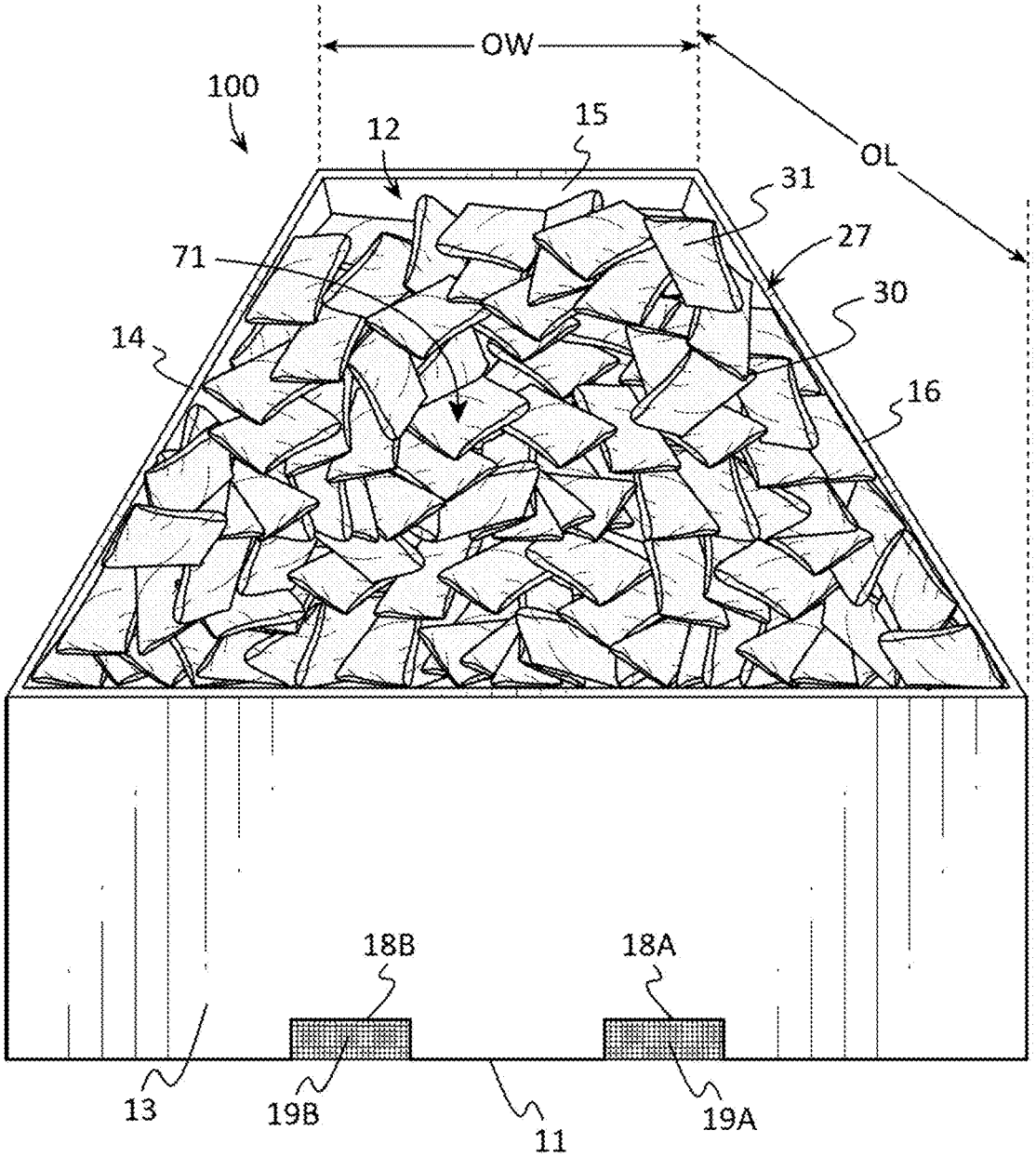
FIG. 1 depicts a perspective view of an example of a three dimensional mattress system according to various embodiments described herein.

For purposes of description herein, the terms "top," "bottom," "upper," "lower," "above," "below," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "approximately" refers to a range of values within plus or minus 10% of the specified number.

A new three dimensional mattress system is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1, 2, and 11-12 illustrate an example of a three dimensional mattress system ("the system") 100 according to various embodiments. In some embodiments, the system 100 may comprise a rigid frame 11 that may form a frame cavity 12. A support grid 21 may be positioned within the frame cavity 12. A plurality of pillows 30 may be positioned within the frame cavity 12 above the support grid 21, so that a user 201 may be supported above the support grid 21 by the plurality of pillows 30. Preferably, as shown in FIG. 1, the plurality of pillows is not enclosed in a cover, bag, or other membrane such that a user's body can sink down between and among the plurality of pillows and, therefore, the plurality of pillows is "coverless." An optional air moving device 41A, 41B, (See FIGS. 1, 7, 12) may be configured to move air to the frame 11 through the plurality of pillows 30.

The system 100 may include a rigid frame 11 which may be constructed to form all or portions of a frame cavity 12. A frame 11 may be made from or comprise steel alloys, aluminum, aluminum alloys, copper alloys, other types of metal or metal alloys, ceramics such as alumina, porcelain, and boron carbide, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are rigid.

A frame 11 may comprise one or more sidewalls 13, 14, 15, 16, which may be sized, shaped, and coupled together to form the shape of the frame 11. Preferably, the frame 11 may comprise one or more sidewalls 13, 14, 15, 16, which may form all or portions of a frame cavity 12. Preferably, and as perhaps best shown in FIGS. 1, 2, 4, and 10-12, the frame 11 will not include a horizontal wall, ceiling, cover, or other membrane at its highest elevation thereby creating a frame cavity that is open on top allowing direct contact between a user and the plurality of pillows such that the plurality of pillows contained with the frame cavity can better conform to a user's body, thereby providing a customizable three dimensional body support experience. A frame 11 may be configured in any shape and size. In some embodiments, a frame 11 may comprise a generally rectangular prism shape. In other embodiments, a frame 11 may comprise a circular or oval cylindrical shape, a triangular prism shape, a pentagonal prism shape, or any other shape, including combinations of shapes. Optionally, the frame 11 may be configured with dimensions that may be approximately equal to the length and width dimensions of standard bed sizes, such as single, twin, full, queen, king, California king, etc.

In some embodiments, one or more parts of the rigid frame 11 may be adjustable, either horizontally or vertically, using one or more of slider hardware, hinges, clasps, locks, motors, or similar mechanisms which may change the configuration of the frame, as one application, assisting a user in entering and/or exiting the frame.

The system 100 may comprise one or more body support areas 71, 72, which may support the body of one or more users 201 that are using the system 100. The one or more body support areas 71, 72, may be formed by a plurality of pillows 30 held in a frame cavity 12 and preferably by one or more support units 23, 23A, 23B, 23C, 23D. In some embodiments, the system 100 may comprise a first body support area 71 that may be formed by a plurality of pillows 30 held in a frame cavity 12 and a second body support area 72 that may be formed by one or more support units 23, 23A, 23B, 23C, 23D, also positioned in the frame cavity 12. In further embodiments, the system 100 may comprise a first body support area 71 that may be formed by a plurality of pillows 30 held in a frame cavity 12 and a second body support area 72 that may be formed by one or more support units 23, 23A, 23B, 23C, 23D, that may be in communication with the frame 11, such that the one or more support units 23, 23A, 23B, 23C, 23D, form at least a portion the frame cavity 12, such as by forming a portion of one or more vertical sides of the frame cavity 12.

The system 100 may be configured in any shape and size. The system 100 may comprise a length dimension (OL) that may describe the overall length of the system 100 and a width dimension (OW) that may describe the overall width of the system 100. In preferred embodiments, the OL and OW may comprise the same measurements as standard sized mattresses, e.g., the OL and OW may comprise substantially the same measurements as a full mattress, queen mattress, king mattress, etc., so that the system 100 may be configured to be supported by standard sized bed frames e.g., full sized bed frames, queen sized bed frames, king sized bed frames, etc. For example, the system 100 may comprise two body support areas 71, 72, in which one is formed by a plurality of pillows 30 held in a frame 11 and the other is formed by one or more support units 23, 23A, 23B, 23C, 23D, and the frame 11 and support units 23, 23A, 23B, 23C, 23D, may be sized and shaped to fit on or be supported by a king sized bed frame.

Figure 10:
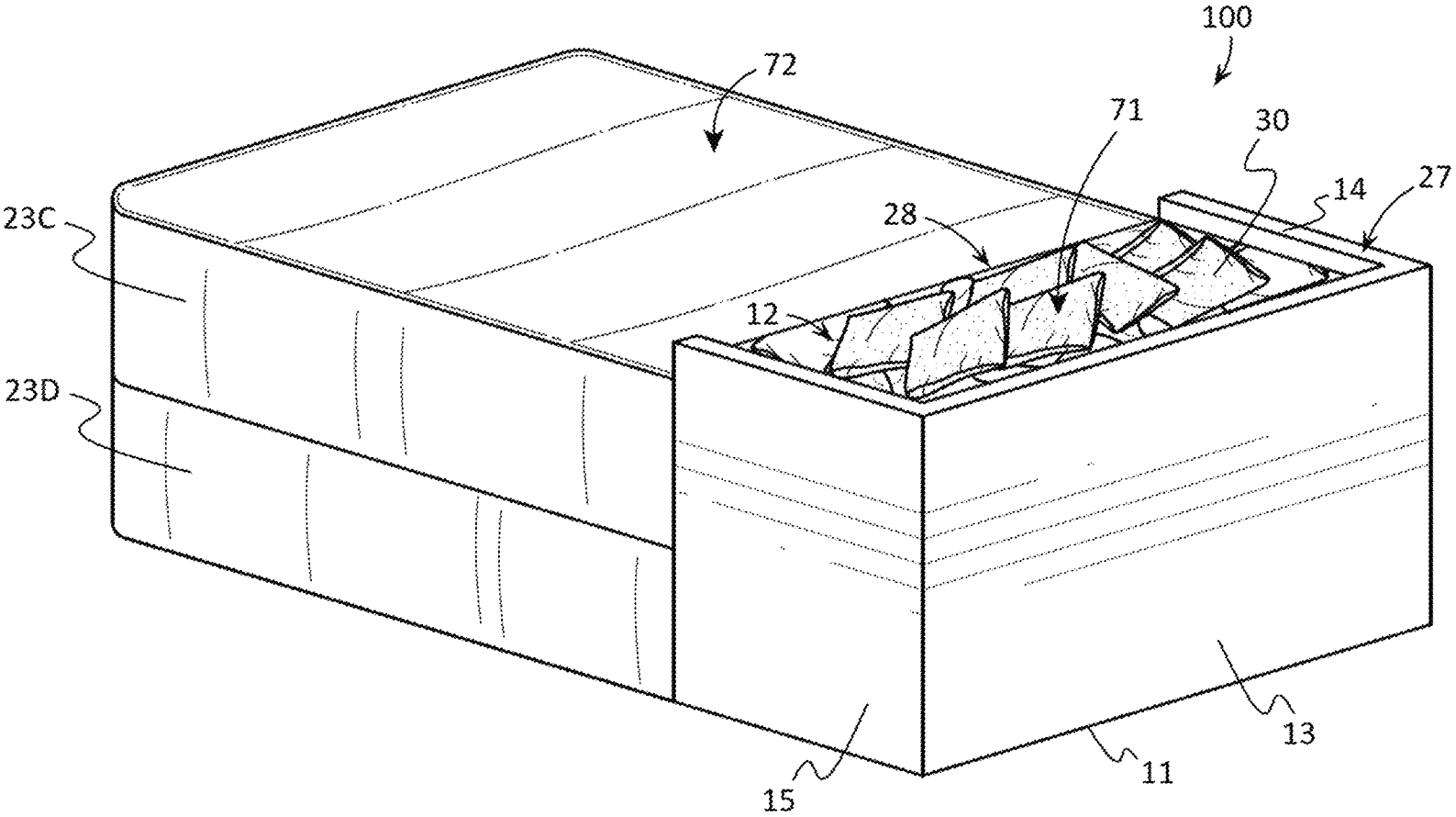
FIG. 10 depicts a perspective view of another example of a three dimensional mattress system according to various embodiments described herein.
Figure 11:
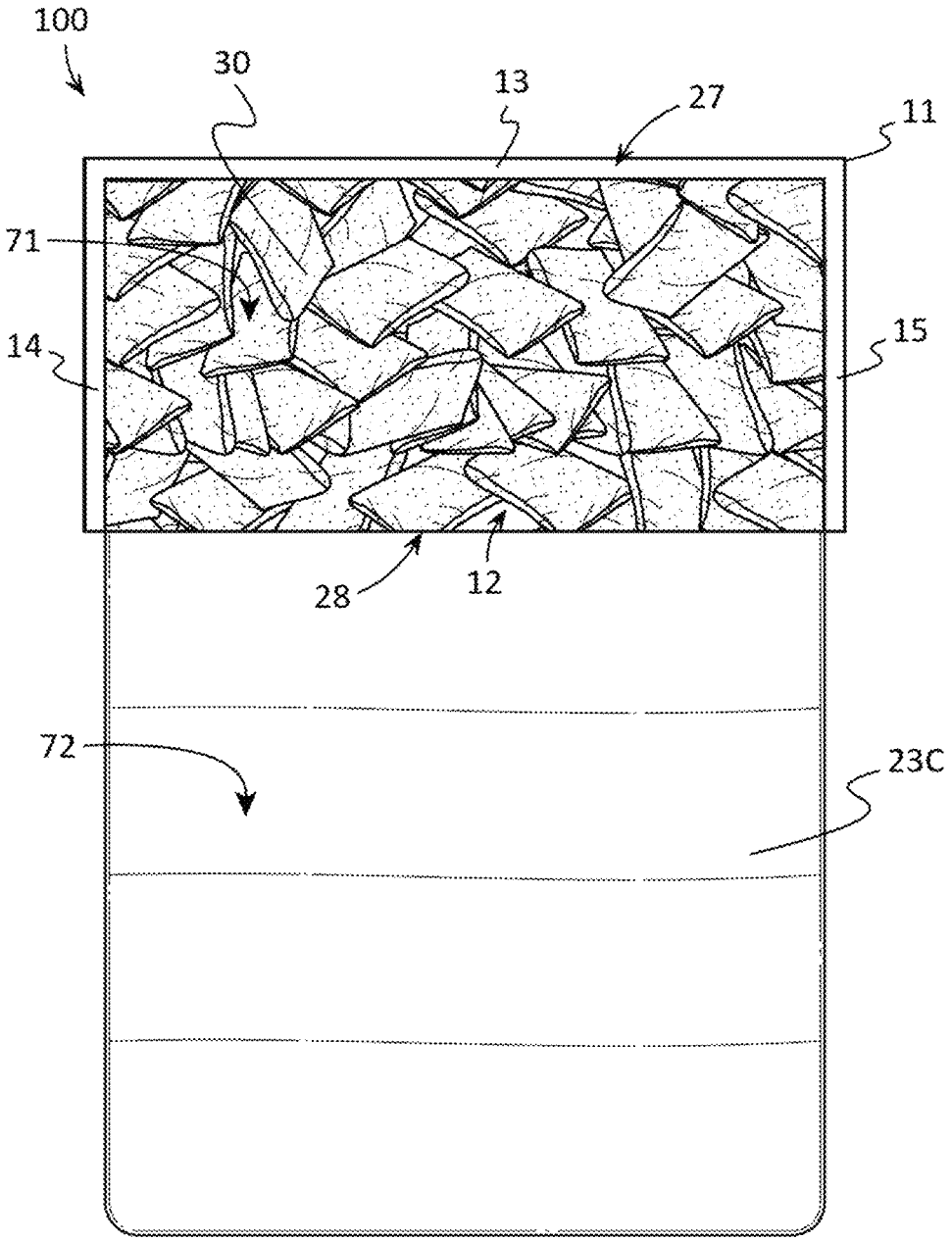
FIG. 11 illustrates a top plan view of another example of a three dimensional mattress system according to various embodiments described herein.
Figure 12:
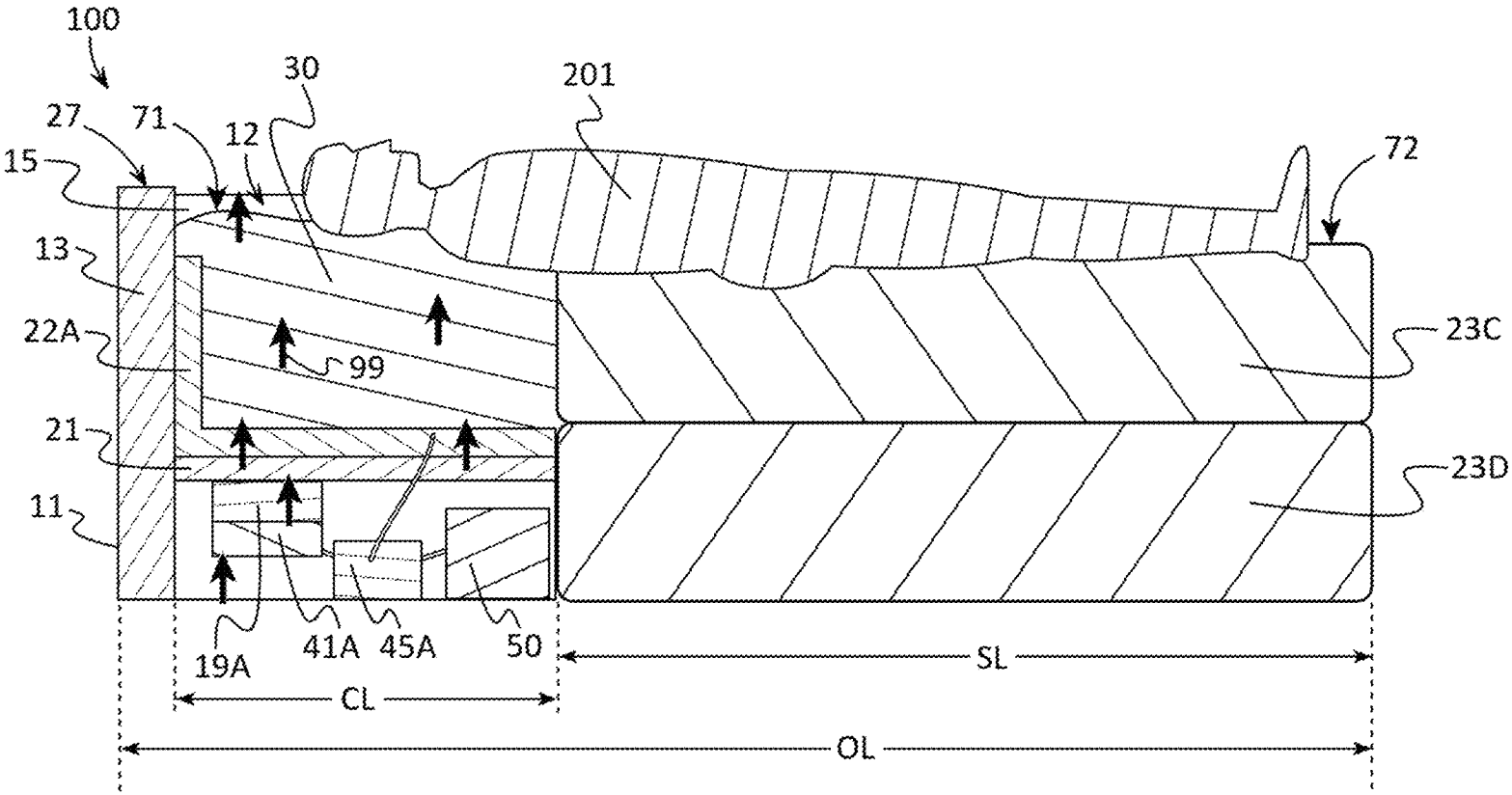
FIG. 12 illustrates a sectional, elevation view of another example of a three dimensional mattress system according to various embodiments described herein.

In preferred embodiments, the system 100 may comprise a plurality of pillows 30 that may form a first body support area 71. Depending on the size and shape of the frame cavity 12 that the plurality of pillows 30 is disposed in, the first body support area 71 may support the entire body of one or more users 201 (FIG. 2), or a first body support area 71 may support a portion of body of one or more users 201 (FIGS. 10-12).

In further preferred embodiments, the system 100 may comprise one or more support units 23, 23A, 23B, 23C, 23D, that may form one or more second body support areas 72. Depending on the size and shape of the one or more support units 23, 23A, 23B, 23C, 23D, a second body support area 72 may support the entire body of one or more users 201, or a second body support area 72 may support a portion of body of one or more users 201 (FIGS. 10-12). For example, a system 100 may comprise a first body support area 71 (formed by a plurality of pillows 30) that may be sized and shaped to support the head and upper torso of one or more users 201, and the system 100 may comprise a second body support area 72 (formed by one or more support units 23, 23A, 23B, 23C, 23D) that may be sized and shaped to support the lower torso and lower body of one or more users 201. As another example, a system 100 suitable for supporting two users 201 may comprise a first body support area 71 (formed by a plurality of pillows 30) that may be sized and shaped to support the head and upper torso of a first user 201, and the system 100 may comprise a second body support area 72 (formed by one or more support units 23, 23A, 23B, 23C, 23D) that may be sized and shaped to support the lower torso and lower body of the first user 201 and to support the entire body of a second user 201 and lying next to the first user 201. This would be useful for two person sleepers or users 201, where one prefers sleeping on a plurality of pillows 30 and the other prefers sleeping on a full length, standard mattress support unit 23, 23A, 23B, 23C, 23D.

Figure 2:
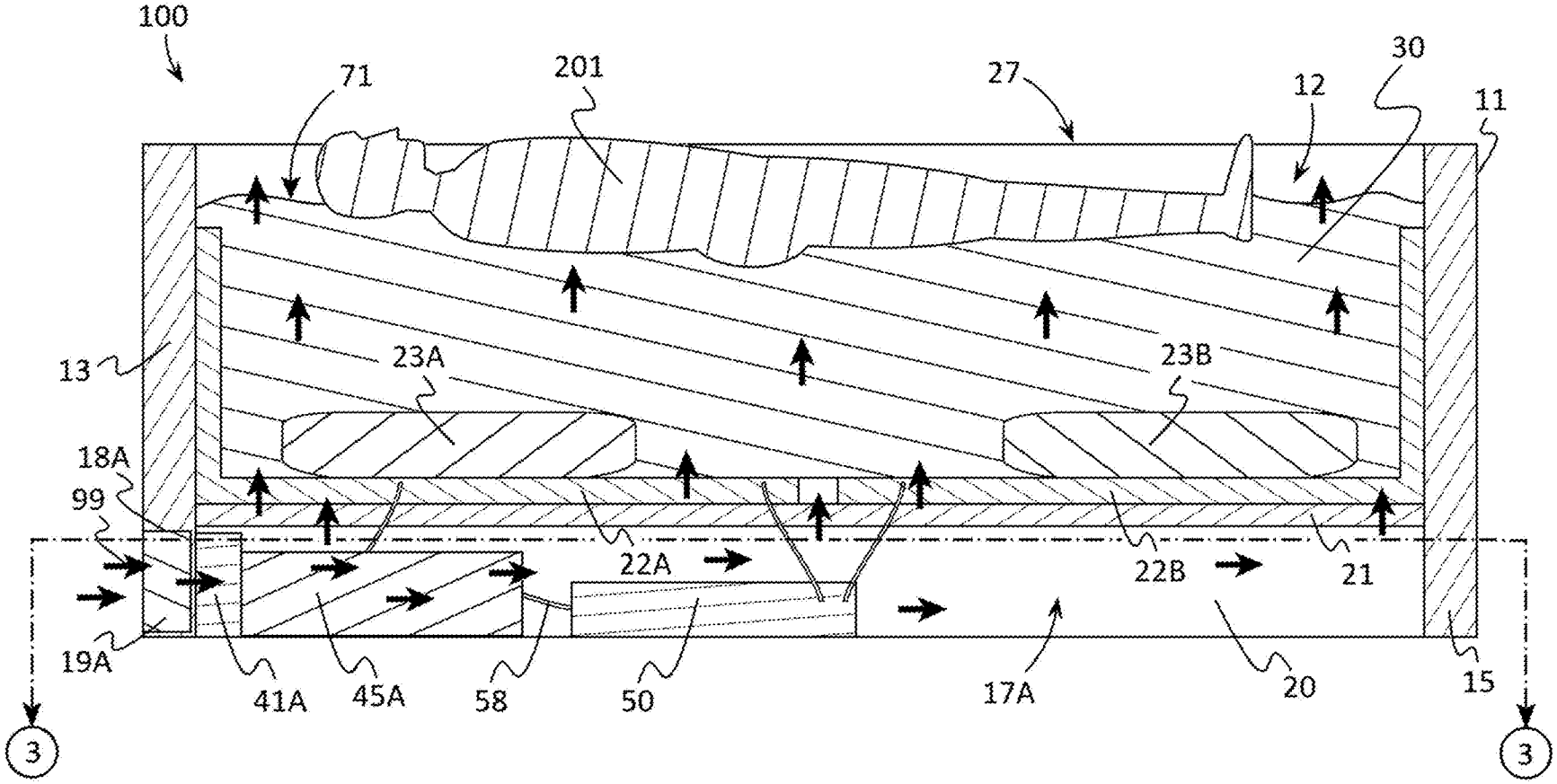
FIG. 2 illustrates a sectional, elevation view of an example of a three dimensional mattress system according to various embodiments described herein.

The system 100 may comprise one or more support units 23, 23A, 23B, 23C, 23D, which may be in communication with the plurality of pillows 30, so as to be positioned proximate to, and more preferably to contact, the plurality of pillows 30. In some embodiments, and as shown in FIG. 2, the system 100 may comprise one or more support units 23, 23A, 23B, 23C, 23D, which may be may be in communication with the plurality of pillows 30 by being disposed in a frame cavity 12. In preferred embodiments, and as shown in FIGS. 10-12, the system 100 may comprise one or more support units 23, 23A, 23B, 23C, 23D, which may be in communication with the plurality of pillows 30 by being positioned proximate to or in contact with the frame 11 so that the one or more support units 23, 23A, 23B, 23C, 23D, may form a portion of the frame cavity 12. Generally, support units 23, 23A, 23B, 23C, 23D, may comprise a structure which may be configured to directly or indirectly support at least a portion of the body or weight of a user 201 who is being supported by the system 100.

A support unit 23, 23A, 23B, 23C, 23D, may be made from or may comprise any material. In some embodiments, a support unit 23, 23A, 23B, 23C, 23D, may be configured as a type of mattress, such as an innerspring mattress, foam mattress, latex mattress, innerspring and foam hybrid mattress, etc. In further embodiments, a support unit 23, 23A, 23B, 23C, 23D, may be configured as a type of cushion, such as a high density foam or other high resiliency foam pad that may be encased in a fabric liner. In still further embodiments, a support unit 23, 23A, 23B, 23C, 23D, may comprise a resilient material or assembly of resilient materials which may be substantially able to regain their shape after deformation. Resilient materials may include silicone foams, rubber foams, urethane foams including plastic foams, neoprene foam, latex foam rubber, polyurethane foam rubber, dense foams (e.g., Nitrile rubber), or elastomer materials such as elastic plastics, elastic silicone, elastic rubbers, or any other suitable elastomer or resilient material including combinations of materials. Resilient materials may also include fabrics of natural and synthetic materials such as, for example, nylon, satin, spandex, cotton, silk, spandex, and polyester or blends thereof, woven materials such as felt, non-woven materials including non-woven spunbond or carded webs of polypropylene, polyethylene, nylon, polyester, a non-woven web of cellulosic fibers, textile fibers such as rayon fibers, or a blend of cellulosic and textile fibers; or melt blown thermoplastic fibers, such as macro fibers or micro fibers of polypropylene, polyethylene, polyester or other thermoplastic materials or mixtures of such thermoplastic macro fibers or micro fibers with cellulosic, pulp or textile fibers, and natural fibers (e.g., wood or cellulose), may be used depending on the particular application. In further embodiments, a support unit 23, 23A, 23B, 23C, 23D, may include various resilient materials, such as viscoelastic foam or a combination of foams and natural and synthetic fibers. In yet further embodiments, a support unit 23, 23A, 23B, 23C, 23D, may be made from or may comprise a generally rigid material, such as wood, particle board, metal, plastic, etc. In yet further embodiments, a support unit 23, 23A, 23B, 23C, 23D, may comprise a bag or sack of liquid, gel, or air. One skilled in the art, however, will realize that other materials suitable for manufacture, in accordance with the present disclosure would be appropriate.

In some embodiments, and as shown in FIG. 2, a support unit 23, 23A, 23B, 23C, 23D, may be positioned within a frame cavity 12 above a support grid 21. For example, a support unit 23, 23A, 23B, 23C, 23D, may be positioned to rest on a support grid 21. As another example, a support unit 23, 23A, 23B, 23C, 23D, may be positioned to rest on one or more pillows 31 above a support grid 21 so as to be separated from the support grid 21 by those pillows 31. Optionally, a support unit 23, 23A, 23B, 23C, 23D, may be manually positioned in a desired location by a user 201. Optionally, a support unit 23, 23A, 23B, 23C, 23D, may be positioned in a desired location by one or more motors or other actuators as selected by a user 201. While the system 100 may comprise any number of support units 23, 23A, 23B, 23C, 23D, preferably the system 100 may comprise a first support unit 23, 23A, 23B, 23C, 23D, which may be positioned below portions of the upper torso of one or more users 201 and a second support unit 23B which may be positioned below portions of the lower torso of one or more users 201 being supported by the system 100. Some embodiments may include one or more support units 23, 23A, 23B, 23C, 23D, that include one or more motors to vary the position of the support unit, vertically and/or horizontally. In such an embodiment, one or more motors is controlled to move a support unit 23, 23A, 23B, 23C, 23D, to a specific position through controller 50 based on input by user 201, or configured as a saved selection, a time schedule, and/or a dynamic sensor input.

A support unit 23, 23A, 23B, 23C, 23D, may be configured in any shape and size. For example, a support unit 23, 23A, 23B, 23C, 23D, may comprise a generally rectangular prism shape, a triangular prism shape, a cylindrical shape, etc. Preferably, a support unit 23, 23A, 23B, 23C, 23D, may comprise a width dimension (SW), a height dimension (SH), and a length dimension (SL). In preferred embodiments, a support unit 23, 23A, 23B, 23C, 23D, may comprise a SL that may be between 55 and 80 percent of OL, and more preferably, approximately 66 percent of OL. In further preferred embodiments, a support unit 23, 23A, 23B, 23C, 23D, may comprise a SW that may be between 25 and 110 percent of OW, and more preferably, between approximately 95 and 105 percent of OW.

In some embodiments, one or more frame cavities 12 may be formed or disposed in the frame 11. In preferred embodiments, a frame cavity 12 may have one or more vertical sides which may be formed by one or more sidewalls 13, 14, 15, 16, of the frame 11, and all or portions of one or more vertical sides of the frame cavity 12 may also be formed by one or more support units 23, 23A, 23B, 23C, 23D. A frame cavity 12 may be configured in any size and shape. Generally, a frame cavity 12 may be sized and shaped to contain a plurality of pillows 30 made up of a volume or number of pillows 31. A frame cavity 12 may comprise a length dimension (CL), a width dimension (CW), and a height dimension (CH), as perhaps best shown in FIG. 4. Optionally, the CL and CW may be approximately equal to the length and width dimensions of standard mattress sizes, such as single, twin, full, queen, king, California king, etc., which have width dimensions of between approximately 38 and 76 inches and length dimensions of between approximately 75 and 84 inches. In preferred embodiments, CL may be between 10 and 90 percent of OL, more preferably CL may be between 20 and 40 percent of OL, and more preferably CL may be approximately 33 percent of OL.

In some embodiments, SW may be between 20 and 110 percent of CW, SH may be between 20 and 100 percent of CH, and SL may be between 20 and 80 percent of CL. In preferred embodiments, SW may be between 95 and 105 percent of CW, and CL may be between 25 and 40 percent of SL. In further preferred embodiments, a support unit 23, 23A, 23B, 23C, 23D, may comprise a width dimension (SW) of approximately the width dimension of a standard sized mattress, a height dimension (SH) of approximately the height dimension of a standard sized mattress, and a length dimension (SL) of approximately the 50 to 80 percent of the length dimension of a standard sized mattress. In further embodiments, a support unit 23, 23A, 23B, 23C, 23D, may comprise a width dimension (SW) of between 500 and 1000 millimeters, such as approximately 750 millimeters, a height dimension (SH) of between 250 and 750 millimeters, such as approximately 500 millimeters, and a length dimension (SL) of between 450 and 950 millimeters, such as approximately 700 millimeters.

In some preferred embodiments, the system 100 may comprise a frame cavity 12, in which the frame cavity 12 is open at its highest elevation, in which, at its highest elevation, the frame cavity 12 has a first vertical perimeter 27 and a second vertical perimeter 28, and in which the first vertical perimeter 27 and the second vertical perimeter 28 are preferably continuous with each other so that the first vertical perimeter 27 and the second vertical perimeter 28 form the highest elevations of the frame cavity 12. Preferably, the first vertical perimeter 27 may be formed by one or more sidewalls 13, 14, 15, 16, of the frame 11, and the second vertical perimeter 28 may be formed by a support unit 23, 23A, 23B, 23C, 23D, that may be in communication with the frame 11. For example, and referring to FIGS. 10-12, the system 100 may have a frame 11 that may comprise a first sidewall 13, a second sidewall 14, and a third sidewall 15. The second sidewall 14 and third sidewall 15 may be coupled to the first sidewall 13 so that the second sidewall 14 and third sidewall 15 may be separated from each other. One or more support units 23, 23A, 23B, 23C, 23D, may be in communication with the fame 11 by being positioned proximate to the second 14 and third 15 sidewalls so that a portion of the one or more support units 23, 23A, 23B, 23C, 23D, extends between the second 14 and third 15 sidewalls. The frame cavity 12 may be open at its highest elevation, and at its highest elevation the frame cavity 12 may be bounded by the first sidewall 13, second sidewall 14, third sidewall 15, and a portion of the one or more support units 23, 23A, 23B, 23C, 23D, that extends between the second 14 and third 15 sidewalls (the sidewalls 13, 14, 15, forming a first vertical perimeter 27 or boundary of the highest elevation the frame cavity 12 and a portion at least one support unit 25A forming a second vertical perimeter 28 or boundary of the highest elevation the frame cavity 12). Preferably, the first vertical perimeter 27 and the second vertical perimeter 28 may be continuous with each other such that pillows 31 of the plurality of pillows 30 are prevented from falling out of or otherwise escaping the frame cavity 12 between the vertical perimeters 27, 28. In this manner, a portion of the plurality of pillows 30 proximate to the highest elevation of the frame cavity 12 may be held in the frame cavity 12 between the second 14 and third 15 sidewalls and between the first sidewall 13 and a portion of the one or more support units 23, 23A, 23B, 23C, 23D, that extends between the second 14 and third 15 sidewalls.

Furthermore, and in this manner, all or at least a portion of the height dimension (CH) of the frame cavity 12 that is bounded by one or more support units 23, 23A, 23B, 23C, 23D, extending between the second 14 and third 15 sidewalls, may be formed by at least a portion of the one or more support units 23, 23A, 23B, 23C, 23D, extending between the second 14 and third 15 sidewalls. As an example, the frame 11 may comprise three vertical sidewalls 13, 14, 15, (forming three vertical sides of the frame cavity 12) that may be coupled together in a generally U-shape or C-shape with one or more support units 23, 23A, 23B, 23C, 23D, forming the fourth vertical side of the frame cavity 12. As another example, the frame 11 may comprise three relatively larger vertical sidewalls 13, 14, 15, (forming three vertical sides of the frame cavity 12) that may be coupled together in a generally U-shape or C-shape, and a relatively smaller fourth vertical sidewall 16 coupled to lower portions of the second 14 and third 15 sidewalls with one or more support units 23, 23A, 23B, 23C, 23D, forming the upper portion of the fourth vertical side of the frame cavity 12 while the fourth vertical sidewall 16 may form the lower portion of the fourth vertical side of the frame cavity 12.

In some embodiments, the system 100 may comprise a support grid 21 which may be positioned within a frame cavity 12. Preferably, a support grid 21 may comprise a structure which may be suitable for supporting a plurality of pillows, one or more users 201, and other objects which are commonly placed on beds and mattresses, above a floor surface. Optionally, a floor surface that a frame 11 may be resting on may be or may function as a support grid 21. Preferably, a support grid 21 may comprise a structure which may be permeable to air and which may be suitable for supporting a plurality of pillows, one or more users 201, and other objects which are commonly placed on beds and mattresses, on or above a floor surface.

In some embodiments, a support grid 21 may comprise a mesh material, such as wire mesh, plastic mesh, lattice material, etc., having a plurality of holes or openings which are smaller in size than the size of each pillow 31. In further embodiments, a support grid 21 may comprise a surface to which one or more, such as a plurality of conduits, may be coupled, and the conduits may be capable of transmitting air while also being smaller in size than the size of each pillow 31. For example, a support grid 21 may comprise a planar sheet of wood having multiple conduits comprising tubing or pipes with perforations which may support the plurality of pillows 30 above a floor surface. In still further embodiments, a support grid 21 may comprise any material which may be capable of supporting the weight of a plurality of pillows, one or more users 201, and other objects which are commonly placed on beds and mattresses, above a floor surface. For example, a support grid 21 may comprise a solid sheet of aluminum, a sheet of fabric, a sheet of plastic, a wood wall, etc.

A support grid 21 may be configured in any size and shape. For example, a frame 11 may comprise four rectangular sidewalls 13, 14, 15, 16, which may be coupled together to form a rectangular prism shaped frame cavity 12, and a rectangular shaped support grid 21 may be disposed or positioned in the frame cavity 12 to extend to and between the sidewalls 13, 14, 15, 16, so that pillows 31 cannot move below the support grid 21. As another example, a support grid 21 may be coupled to a frame 11 by being coupled below the frame 11 so that the support grid 21 may support the frame 11 in addition to the plurality of pillows 30 above a floor surface.

Figure 3:
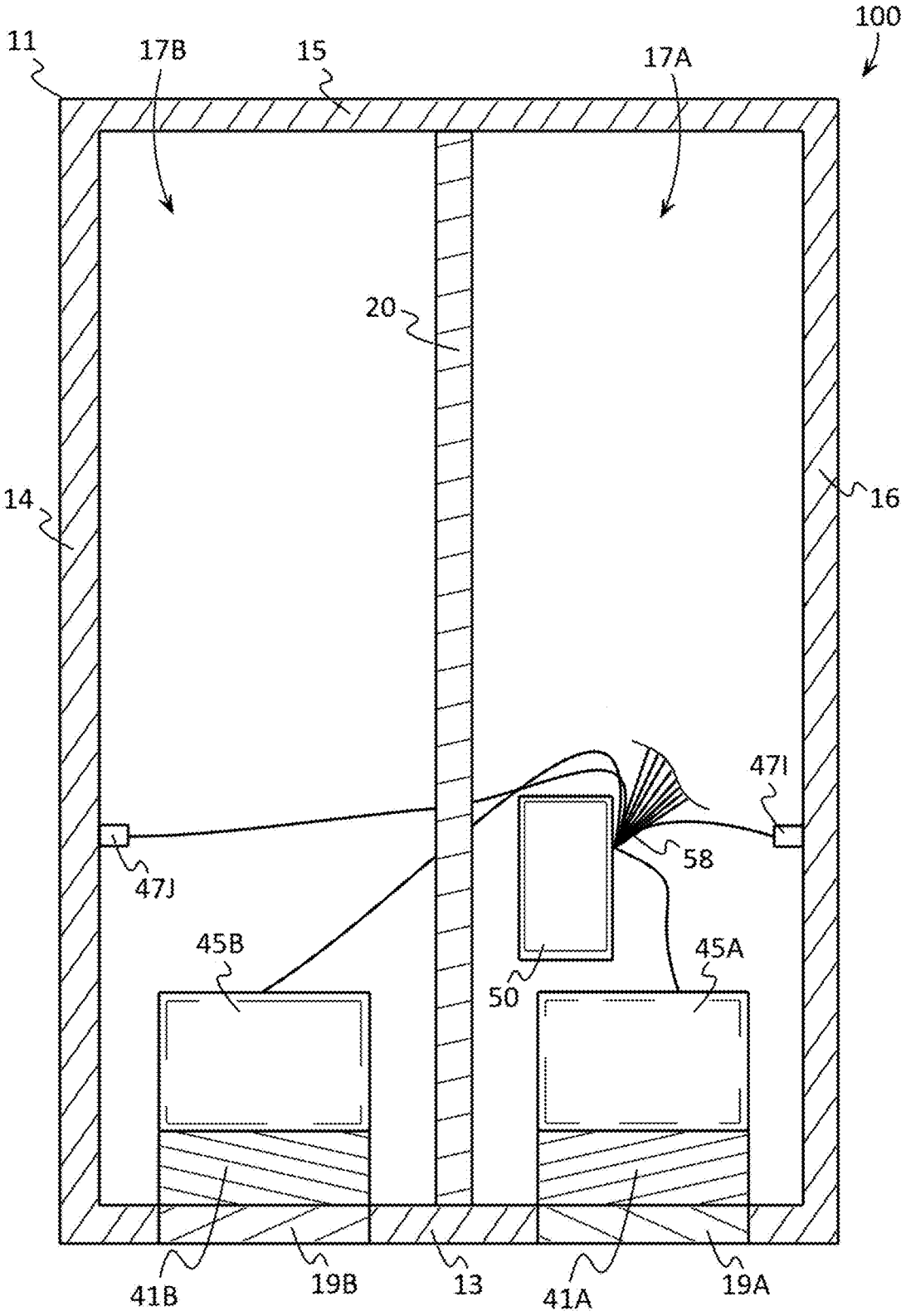
FIG. 3 depicts a sectional, through line 3-3 shown in FIG. 2, elevation view of an example of a three dimensional mattress system according to various embodiments described herein.
Figure 4:
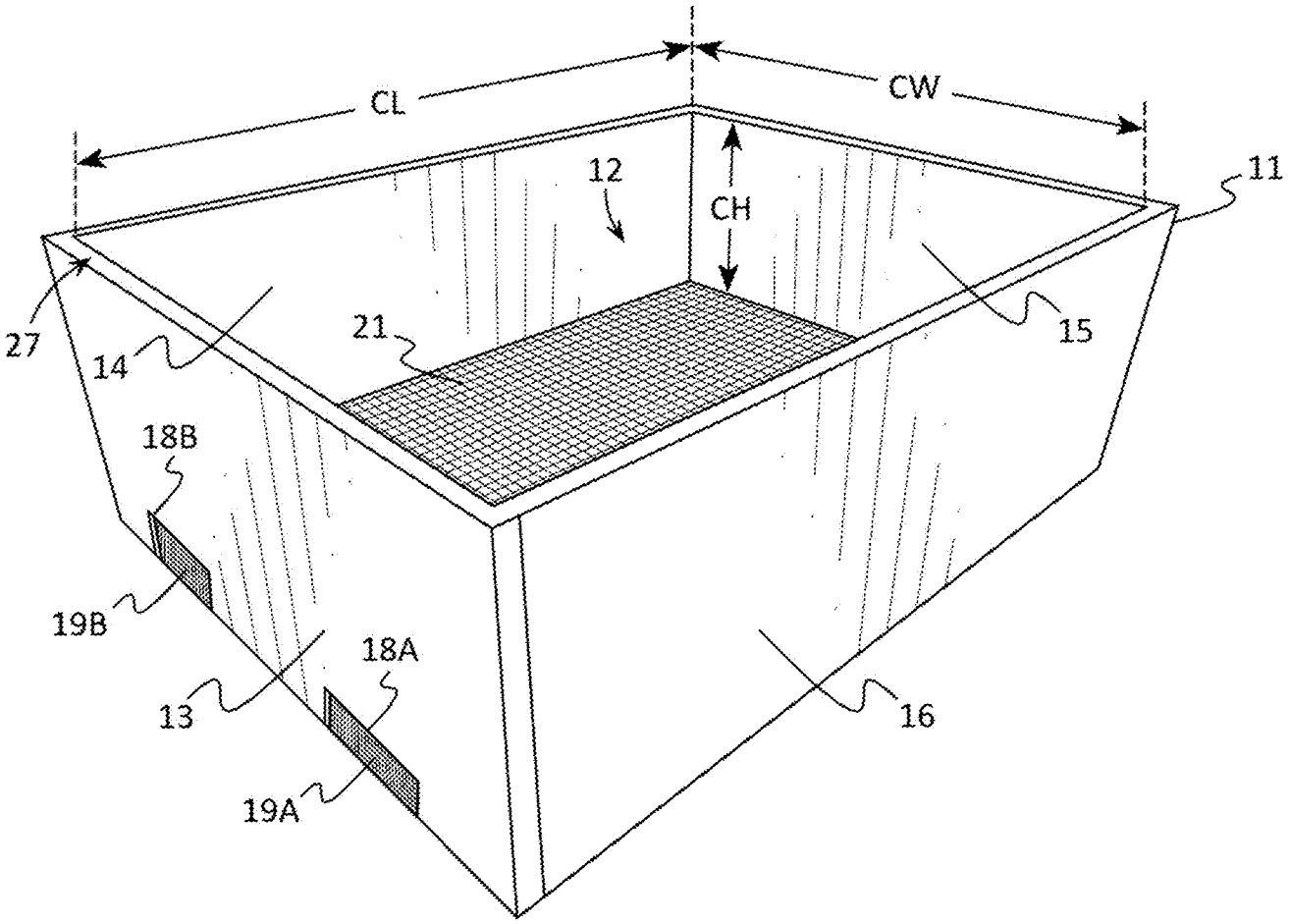
FIG. 4 shows a perspective view of an example of a frame of a three dimensional mattress system according to various embodiments described herein.

In some embodiments, the system 100 may comprise one or more optional air spaces 17A, 17B, either alone or in combination, which may be formed below a support grid 21, as perhaps best shown in FIGS. 2, 3, and 12. Generally, an air space 17A, 17B may comprise a portion of the frame 11 and/or frame cavity 12 which may be devoid of pillows 31. In further embodiments, a support grid 21 may be positioned in a frame cavity 12, and the support grid 21 may prevent pillows 31 from passing the support grid 21, thereby forming an air space 17A, 17B below the support grid 21. Preferably, one or more electronic components of the system 100, such as a controller 50, may be positioned within an air space 17A, 17B. Two air spaces 17A and 17B may be formed with an internal frame wall 20 as shown in FIG. 3, which may enable each air space 17A and 17B to support individual temperature and airflow control, preferably by each air space 17A and 17B having or being in communication with an environmental control device 45A, 45B. The two air spaces 17A and 17B may include multiple temperature regulators 22A, 22B, 22C, 22D, at least two air moving devices 41A, 41B, optionally two environmental control devices 45A, 45B, and multiple sensors 47A, 47B, 47C, 47D, 47E, 47F, 47G, 47H, 47I, 47J to independently control the temperature and airflow for each of a first and second user 201. Alternatively, where separate, individual temperature and airflow control is not desired, a single air space may be formed by removing internal frame wall 20. In such an embodiment, as few as one temperature regulator, air moving device, environmental control device, and sensor may be used.

The system 100 may comprise a plurality of pillows 30 which may be formed by any number of pillows 31. For example, plurality of pillows 30 may comprise greater than twenty pillows 31, greater than fifty pillows 31, more preferably greater than one hundred pillows 31, and more preferably greater than one hundred fifty pillows 31, such as over two thousand pillows 31. Preferably, the pillows 31 in the plurality of pillows 30 are not physically attached to one another and are substantially independent of one another such that they can move freely within the frame cavity 12. And preferably, the entire or at least a portion of the plurality of pillows 30 is not enclosed in a cover, bag, or membrane such that a user's body can sink down between and among the individual pillows 31 as they move freely within the frame cavity. FIG. 1 depicts an embodiment where the entire plurality of pillows 30 is not enclosed in a cover, bag, or membrane, i.e., entirely "coverless." Generally, a pillow 31 may comprise a resilient material or assembly of resilient materials which may be substantially able to regain their shape after deformation. Resilient materials may include silicone foams, rubber foams, urethane foams including plastic foams, neoprene foam, latex foam rubber, polyurethane foam rubber, dense foams (e.g., Nitrile rubber), or elastomer materials such as elastic plastics, elastic silicone, elastic rubbers, or any other suitable elastomer or resilient material including combinations of materials. Furthermore, resilient material(s) of pillows 31 may be selected based on the porosity and/or thermal conductivity characteristics of the resilient material(s). Resilient materials may also include fabrics of natural and synthetic materials such as, for example, nylon, satin, spandex, cotton, wool, silk, spandex, and polyester or blends thereof, woven materials such as felt, non-woven materials including non-woven spunbond or carded webs of polypropylene, polyethylene, nylon, polyester, a non-woven web of cellulosic fibers, textile fibers such as rayon fibers, or a blend of cellulosic and textile fibers; or melt blown thermoplastic fibers, such as macro fibers or micro fibers of polypropylene, polyethylene, polyester or other thermoplastic materials or mixtures of such thermoplastic macro fibers or micro fibers with cellulosic, pulp or textile fibers, and natural fibers (e.g., wood or cellulose), may be used depending on the particular application. In further embodiments, a pillow 31 may include various resilient materials, such as viscoelastic foam or a combination of foams and natural and synthetic fibers. In yet still further embodiments, a pillow 31 may comprise a bag or sack of liquid, gel, or air. One skilled in the art, however, will realize that other materials suitable for manufacture, in accordance with the present disclosure would be appropriate.

Pillow 31, or Pillows 31 as used herein includes any sort of resilient or cushion material, of any shape, density, with or without an exterior bag. As a preferred example, a pillow 31 may comprise a rectangular prism shape, be cotton fiber filled, and comprise a cotton cloth enclosure which may contain the cotton fiber filling. Preferably, a pillowcase removable for laundering is used over the cloth enclosure of a pillow 31, particularly where all or at least a portion of the plurality of pillows 30 are not enclosed in a cover, bag, or membrane, whereby a user's body can sink down between and among the plurality of pillows 30 and will come into contact with all or at least a portion of the plurality of pillows 30. It should be understood that pillows 31 may be configured in any shape and size. For example, a pillow 31 may comprise a generally cylindrical shape, a spherical shape, a triangular prism shape, a rectangular prism shape, an irregular shape, etc. Additionally, it should be understood that a plurality of pillows 30 may comprise one or more pillows 31 having a shape, size, material composition, that may be different from one or more other pillows 31 of the plurality of pillows 30.

Figure 5:
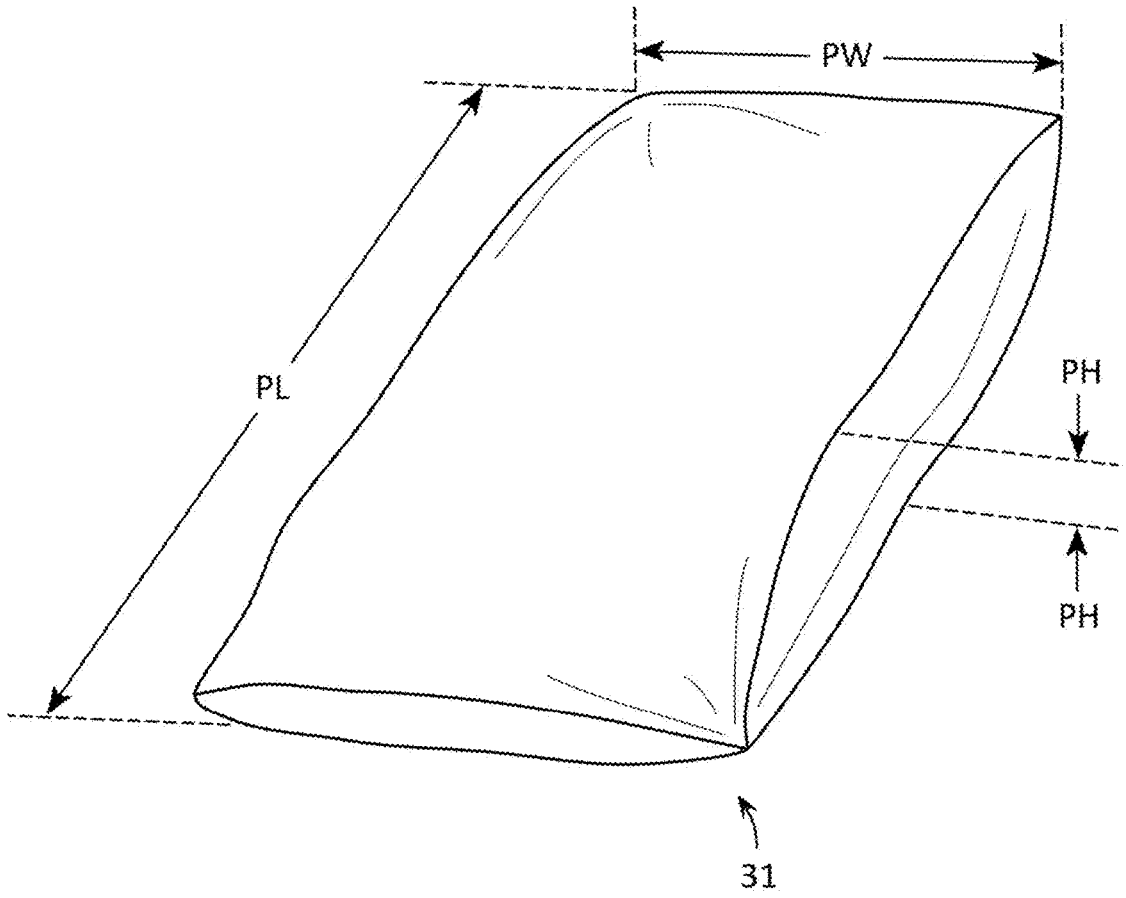
FIG. 5 depicts a perspective view of an example of a pillow according to various embodiments described herein.
Figure 6:
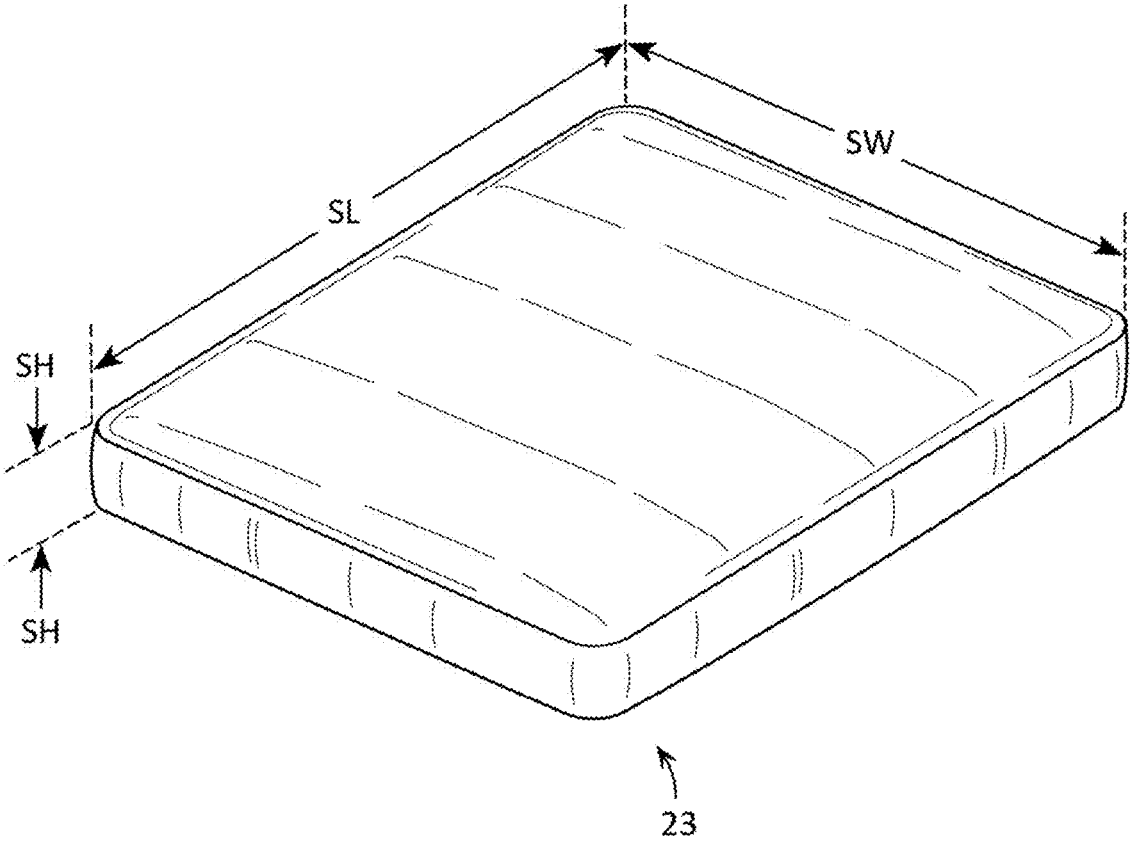
FIG. 6 illustrates a perspective view of an example of a support unit according to various embodiments described herein.

As shown in FIG. 5, each pillow 31 of the plurality of pillows 30 may comprise a height dimension (PH), a width dimension (PW), and a length dimension (PL). While the system 100 may comprise a plurality of pillows 30 comprising a number of pillows 31 of any shape and size, in preferred embodiments, each pillow 31 of the plurality of pillows 30 may comprise a PW of between 0.5 and 36.0 inches, a PL of between 0.5 and 36.0 inches, and a PH of between 0.5 and 12.0 inches. In further embodiments, each pillow 31 of the plurality of pillows 30 may comprise a PW of between 0.1 and 72.0 inches, a PL of between 0.1 and 72.0 inches, and a PH of between 0.1 and 24.0 inches. Preferably, as shown in FIG. 5, each pillow 31 of the plurality of pillows 30 comprises a generally rectangular prism shape.

The system 100 may comprise one or more air moving devices 41A, 41B, (see FIGS. 2, 3, 7, and 12) which may be configured to motivate air, and preferably air that is external to the frame 11, through the plurality of pillows 30 as shown by arrows 99 (FIG. 2). In some embodiments, an air moving device 41A, 41B, may be configured to motivate air that is preferably external to the frame 11 into the frame 11 through one or more vents 18A, 18B, and then up through a support grid 21 and through the plurality of pillows 30 (see FIG. 1). Generally, a vent 18A, 18B, may comprise an opening of any size and shape in one or more sidewalls 13, 14, 15, 16, of the frame 11 which may conduct air through the sidewalls 13, 14, 15, 16.

In some embodiments, an air moving device 41A, 41B, may be positioned external to the frame 11 and a frame cavity 12. In further embodiments, an air moving device 41A, 41B, may be positioned internal to the frame 11 and a frame cavity 12, such as by being positioned within an air space 17A, 17B. In further embodiments, an air moving device 41A, 41B, may include one or more conduits, such as tubing, piping, etc., which may direct air motivated by the air moving device 41A, 41B, up through the plurality of pillows 30. For example, the system 100 may comprise one or more, such as a plurality of conduits (e.g., pipes with perforations) at the bottom of the frame 11, such as around the perimeter of the frame cavity 12, or anywhere below, into, or through the plurality of pillows 30. It should be understood that an air moving device 41A, 41B, may be positioned anywhere relative to a frame 11 with any device or method used to provide fluid communication between the air moving device 41A, 41B, and the plurality of pillows 30 so that the air moving device 41A, 41B, may motivate air through the plurality of pillows 30, and more preferably up through the plurality of pillows 30. For example, the system 100 may comprise one or more air moving devices 41A, 41B, that may be mounted or coupled to the outside of the frame 11, above a support grid 21 with conduit or other fluid communication enabling devices configured to provide the air motivated by the air moving devices 41A, 41B, into and through the plurality of pillows 30. As another example, the system 100 may comprise one or more air moving devices 41A, 41B, optionally with the air moving devices 41A, 41B, installed in housings, that may be mounted or coupled around the bottom perimeter of the frame 11 within, partially within, or external to the frame cavity 12 and above the support grid 21 so as to enable the height of the frame 11 to be lower.

An air moving device 41A, 41B, may comprise any device configured to cause, motivate, or direct air flow. Optionally, an air moving device 41A, 41B, may comprise any device configured to modify or regulate air gas concentrations. For example, an air moving device 41A, 41B, may include a rotating arrangement of vanes or blades capable of moving air, such as a rotary vane pump, a diaphragm pump, a piston pump, a scroll pump, a screw pump, a Wankel pump, an external vane pump, a roots blower or booster pump, a multistage roots pump, a blower fan, a vane pump, axial-flow fans, centrifugal fans, cross-flow fans, bellows, Coandă effect air movers, electrostatic air movers, oxygen generators or any other device or method capable of moving air and/or modifying or regulating air gas concentrations.

In some embodiments, the system 100 may comprise one or more air filters 19A, 19B, that may be configured to filter air moved by or motivated by an air moving device 41A, 41B, so that the air filter 19A, 19B, may filter air that is moved through the frame cavity 12 and the plurality of pillows 30. Optionally, an air filter 19A, 19B, may be a component of an air moving device 41A, 41B. An air filter 19A, 19B, may be positioned anywhere in the path of air that is motivated by an air moving device 41A, 41B. For example, an air filter 19A, 19B, may be coupled to an air moving device 41A, 41B, and/or an air filter 19A, 19B, may be coupled to a vent 18A, 18B.

In some embodiments, an air filter 19A, 19B, may comprise a UV light filter, an electrostatic filter, a washable filter, a media filter, a spun glass filter, a pleated filter, etc. In further embodiments, an air filter 19A, 19B, may comprise a medical grade air filter that may utilize high-efficiency filtration including HEPA filters, ULPA filters, and ASHRAE filters for particles, bacteria, and some viruses. Optionally, an air filter 19A, 19B, may comprise one or more activated carbon filters that adsorb chemical vapors to effectively remove chemical fumes and VOCs from the airflow.

In some embodiments, the system 100 may comprise one or more temperature regulators 22A, 22B, 22C, 22D, (see FIGS. 7 and 12) which may be configured to generate heat in and/or to remove heat from one or more locations of the system 100. Example temperature regulators 22A, 22B, 22C, 22D, include: heating pads; other devices having electric heating elements; electric heating and cooling units, such as absorption chillers, compressor chillers, heat pumps, those using the Peltier effect (e.g., thermoelectric heat pump and other devices using Thermoelectric Peltier Refrigeration Cooling Systems and Semiconductors); etc. Temperature regulators 22A, 22B, 22C, 22D, may be positioned anywhere in the system 100, and more preferably, one or more temperature regulators 22A, 22B, 22C, 22D, may be positioned within the frame 11, such as above and/or below a support grid 21. In preferred embodiments, the system 100 may comprise one or more temperature regulators 22A, 22B, 22C, 22D, which may be positioned above a support grid 21. In further preferred embodiments, the system 100 may comprise one or more temperature regulators 22A, 22B, 22C, 22D, which may be shaped, sized, positioned, or otherwise configured to generate heat which may be directed to one or more portions of a frame cavity 12, an air space 17A, 17B, plurality of pillows 30, and/or one or more users 201 which may be supported by the plurality of pillows 30. For example, a system 100 may comprise a frame cavity 12 holding a plurality of pillows 30 that is able to support two users 201, and the system 100 may include: a first temperature regulator 22A that may generate heat which may be directed to a first portion of the plurality of pillows 30 that is under the upper body of the first user 201; a second temperature regulator 22B that may generate heat which may be directed to a second portion of the plurality of pillows 30 that is under the lower body of the first user 201; a third temperature regulator 22C that may generate heat which may be directed to a third portion of the plurality of pillows 30 that is under the upper body of the second user 201; and a fourth temperature regulator 22D that may generate heat which may be directed to a fourth portion of the plurality of pillows 30 that is under the lower body of the second user 201. In further embodiments, one or more pillows 31 may comprise a temperature regulator 22A, 22B, 22C, 22D. In still further embodiments, one or more support units 23, 23A, 23B, 23C, 23D, may comprise a temperature regulator 22A, 22B, 22C, 22D.

Temperature regulators 22A, 22B, 22C, 22D, may be positioned anywhere in the frame 11. In some embodiments, a temperature regulator 22A, 22B, 22C, 22D, may be positioned below a support grid 21, such as in an optional air space 17A, 17B. In preferred embodiments, a temperature regulator 22A, 22B, 22C, 22D, may be positioned above a support grid 21, such as by optionally resting on the support grid 21 and/or by being positioned within and/or above the plurality of pillows 30. In preferred embodiments, a temperature regulator 22A, 22B, 22C, 22D, and/or a portion of a temperature regulator 22A, 22B, 22C, 22D, may extend along the frame 11 and above the support grid 21 so as to contact or rest against a portion of a sidewall 13, 14, 15, 16, as shown in FIG. 2.

In some embodiments, the system 100 may comprise one or more environmental control devices 45A, 45B, that may be configured to control the temperature and/or air gas concentrations of air moved through the support grid 21 by an air moving device 41A, 41B. An environmental control device 45A, 45B, may be positioned in an optional air space 17A, 17B, coupled to the frame 11, or positioned anywhere, such as exterior to the frame 11, so that the environmental control device 45A, 45B, may be in communication with air that is motivated by an air moving device 41A, 41B. Optionally, an environmental control device 45A, 45B, may be coupled to or integrally assembled with an air moving device 41A, 41B.

In preferred embodiments, an environmental control device 45A, 45B, may be configured to control the temperature of air moved through the support grid 21 by heating and/or cooling the air. For example, an environmental control device 45A, 45B, may include: PCO (photocatalytic oxidation) heater combination units; electric heating and cooling units, such as those using the Peltier effect (e.g., thermoelectric heat pump); an absorption chiller, regulated absorption cooling unit, or absorption refrigerator that may be a refrigerator that uses a heat source (e.g., solar energy, a fossil-fueled flame, waste heat from electronics, or district heating systems) to provide the energy needed to drive the cooling process; micro-refrigeration coils; or electric heating elements. In further embodiments, an environmental control device 45A, 45B, may comprise any device or method that may be used for heating and/or cooling air moved through the support grid 21, and therefore heating and/or cooling air moved through the plurality of pillows 30.

In further preferred embodiments, an environmental control device 45A, 45B, may be configured to control the humidity of air moved through the support grid 21. For example, an environmental control device 45A, 45B, may include: a heat pump dehumidifier; a chemical dehumidifier; a warm mist humidifier; a cool mist humidifier; or any other device or method that may be used to add and/or remove moisture from air moved through the support grid 21, and therefore to add and/or remove moisture from air moved through the plurality of pillows 30, in order to control the humidity of the moved air.

Figure 7:
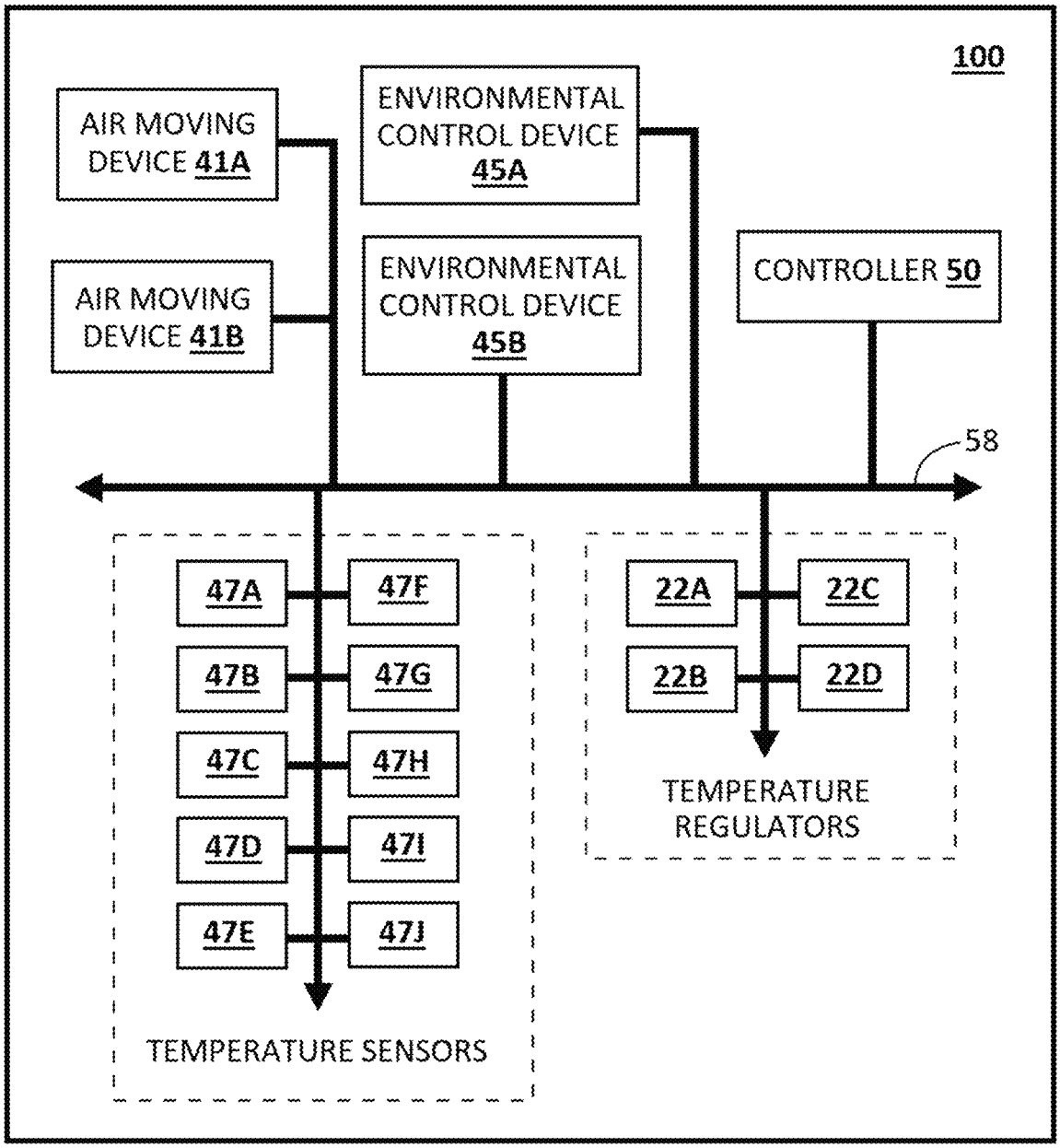
FIG. 7 shows a block diagram of some example components of a three dimensional mattress system according to various embodiments described herein.

In some embodiments, as shown in FIG. 7, the system 100 may comprise one or more sensors 47A, 47B, 47C, 47D, 47E, 47F, 47G, 47H, 47I, 47J, which may be configured to measure environmental or other data that may include: the temperature of one or more elements, humidity, air pressure, gas concentrations, user body temperature, user heart rate, user galvanic skin response, user motion, user audible output, user blood pressure, air flow, and/or temperatures of one or more areas of the system 100 and to communicate this environmental data to a controller 50. Preferably, a sensor 47A, 47B, 47C, 47D, 47E, 47F, 47G, 47H, 47I, 47J, may measure temperature and generate temperature data which may describe the measured temperature. Sensors 47A, 47B, 47C, 47D, 47E, 47F, 47G, 47H, 47I, 47J, may be located anywhere in the system, such as by being coupled to an element of the system 100. In preferred embodiments, the system 100 may comprise: a first sensor 47A that may be coupled to the frame 11 proximate to where the head of a first user 201 may be located when supported by the plurality of pillows 30; a second sensor 47B that may be coupled to the frame 11 proximate to where the head of a second user 201 may be located when supported by the plurality of pillows 30; a third sensor 47C that may be coupled to the frame 11 proximate to where the middle of a first user's 201 body may be located when supported by the plurality of pillows 30; a fourth sensor 47D that may be coupled to the frame 11 proximate to where the middle of a second user's 201 body may be located when supported by the plurality of pillows 30; a fifth sensor 47E that may be coupled to the frame 11 proximate to where the feet of a first user 201 may be located when supported by the plurality of pillows 30; a sixth sensor 47F that may be coupled to the frame 11 proximate to where the feet of a second user 201 may be located when supported by the plurality of pillows 30; a seventh sensor 47G that may be coupled an upper side the support grid 21 (side supporting plurality of pillows 30); an eighth sensor 47H that may be coupled to a lower side of the support grid 21 (opposite side supporting plurality of pillows 30); a ninth sensor 47I and tenth sensor 47J that may be coupled in an optional air space 17A, 17B, such as proximate to the floor or surface that the frame 11 may be resting on.

In some embodiments, the system 100 may comprise a controller 50 that may be in communication with and configured to control the functions of one or more elements, such as temperature regulators 22A, 22B, 22C, 22D, air moving devices 41A, 41B, environmental control devices 45A, 45B, sensors 47A, 47B, 47C, 47D, 47E, 47F, 47G, 47H, 47I, 47J, support units 23, 23A, 23B, 23C, 23D, etc., of the system 100. In some embodiments and in the present example, the controller 50 can be a digital device that, in terms of hardware architecture, optionally includes a processor 51, input/output (I/O) interfaces 52, a network interface 53, a data store 54, and memory 55. It should be appreciated by those of ordinary skill in the art that FIG. 8 depicts the controller 50 in an oversimplified manner, and a practical embodiment may include additional components or elements and suitably configured processing logic to support known or conventional operating features that are not described in detail herein.

Figure 8:
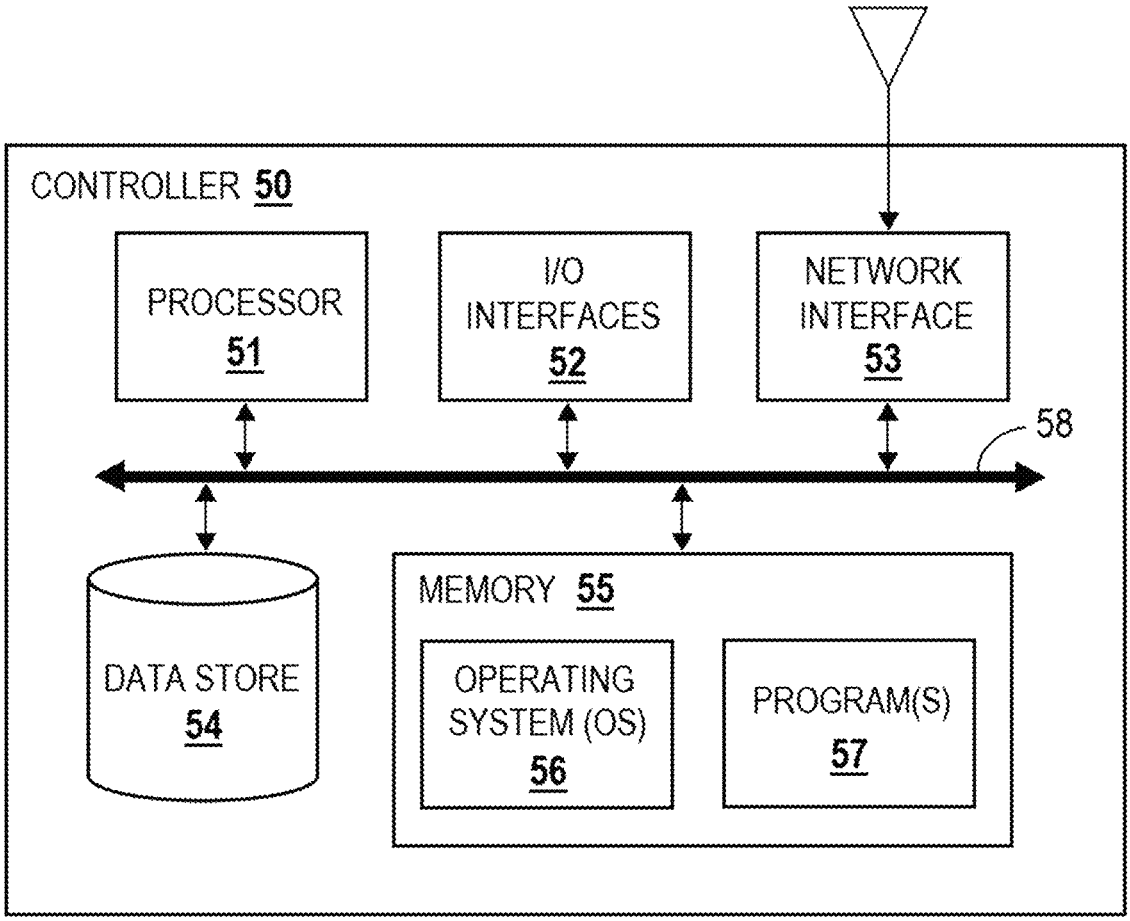
FIG. 8 depicts a block diagram of some example components of a controller of a three dimensional mattress system according to various embodiments described herein.

As shown in FIGS. 7 and 8, the controller 50 components and elements (51, 52, 53, 54, 55) are communicatively coupled via a local interface 58, and one or more local interfaces 58 may communicatively couple the controller 50 to one or more temperature regulators 22A, 22B, 22C, 22D, air moving devices 41A, 41B, environmental control device 45A, 45B, sensors 47A, 47B, 47C, 47D, 47E, 47F, 47G, 47H, 47I, 47J, etc., of the system 100. The local interface 58 can be, for example but not limited to, one or more buses, electrical relays, circuit boards, wiring harnesses, or other wired connections or wireless connections, as is known in the art. The local interface 58 can have additional elements, which are omitted for simplicity, such as controllers, buffers (caches), drivers, repeaters, and receivers, among many others, to enable communications. Further, the local interface 58 may include address, control, and/or data connections to enable appropriate communications among the aforementioned components.

The processor 51 is a hardware device for executing software instructions. The processor 51 can be any custom made or commercially available processor, a central processing unit (CPU), an auxiliary processor among several processors associated with the controller 50, a semiconductor-based microprocessor (in the form of a microchip or chip set), or generally any device for executing software instructions. When the controller 50 is in operation, the processor 51 is configured to execute software stored within the memory 55, to communicate data to and from the memory 55, and to generally control operations of the system 100 pursuant to the software instructions and/or from instructions received from an electronic device, such as a smartphone, tablet computer, laptop computer, desktop computer, etc., that may be in communication with the system 100 via a network interface 53. In an exemplary embodiment, the processor 51 may include a mobile optimized processor, such as optimized for power consumption and mobile applications.

The I/O interfaces 52 can be used by a user 201 to provide user input and display system output data, such as operational status, data history, and user sleep analysis, from the system 100. The I/O interfaces 52 can include, for example, buttons, knobs, switches, LED indicator lights, LED display, LCD display, a serial port, a parallel port, a small computer system interface (SCSI), an infrared (IR) interface, a radio frequency (RF) interface, a universal serial bus (USB) interface, and the like. In some embodiments, I/O interfaces 52 may comprise buttons, knobs, switches, etc., that may be manipulated by a user 201 to enable the user to select one or more settings for temperature regulators 22A, 22B, 22C, 22D, air moving devices 41A, 41B, environmental control devices 45A, 45B, sensors 47A, 47B, 47C, 47D, 47E, 47F, 47G, 47H, 47I, 47J, external devices, such as lights, sound system, central HVAC system, etc., of the system 100.

Figure 9A:
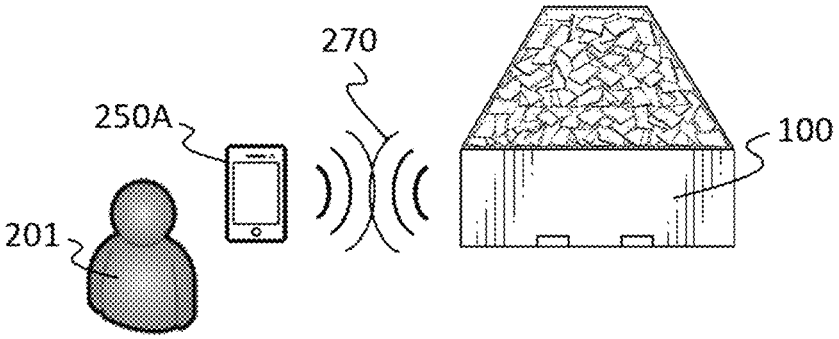
FIG. 9A illustrates a perspective view of an example of a three dimensional mattress system in wireless communication with an electronic device according to various embodiments described herein.
Figure 9B:
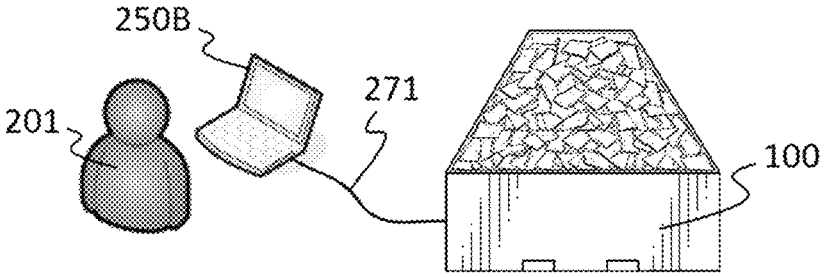
FIG. 9B shows a perspective view of an example of a three dimensional mattress system in wired communication with an electronic device according to various embodiments described herein.

An optional network interface 53 enables wireless communication 270 (FIG. 9A) and/or wired communication 271 (FIG. 9B) to an external access device, such as an electronic device 250A, 250B, or network. A network interface 53 may enable a user 201 to provide user input to the system 100 and to receive system 100 status data via an electronic device, such as a smartphone, tablet computer, laptop computer, desktop computer, etc., to enable the user to select or view one or more settings for temperature regulators 22A, 22B, 22C, 22D, air moving devices 41A, 41B, environmental control devices 45A, 45B, sensors 47A, 47B, 47C, 47D, 47E, 47F, 47G, 47H, 47I, 47J, etc., of the system 100. In this manner, the controller 50 may be configured to receive user input via an electronic device 250A, 250B, that is in electronic communication with the network interface 53. As an example, temperature regulators 22A, 22B, 22C, 22D, temperatures and air moving device 41A, 41B, settings may be controlled and maintained via a web browser, web portal, smartphone application, etc., of an electronic device that is in communication with a network interface 53 of the system 100.

In preferred embodiments, a network interface 53 may comprise a radio that may operate via WiFi and/or Bluetooth communication standards. In further embodiments, a network interface 53 may comprise a radio that may operate on a cellular band and may communicate with or receive a Subscriber Identity Module (SIM) card or other wireless network identifier. Any number of suitable wireless data communication protocols, techniques, or methodologies can be supported by a network interface 53, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Near-Field Communication (NFC); Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication. In further embodiments, a network interface 53 may enable wired network communication and may include, for example, an Ethernet card or adapter (e.g., 10BaseT, Fast Ethernet, Gigabit Ethernet, 10 GbE) or a wireless local area network (WLAN) card or adapter (e.g., 802.11a/b/g/n). The network interface 53 may include address, control, and/or data connections to enable appropriate communications on the network.

An optional data store 54 may be used to store data. The data store 54 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 54 may incorporate electronic, magnetic, optical, and/or other types of storage media.

The memory 55 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 55 may incorporate electronic, magnetic, optical, and/or other types of storage media. Note that the memory 55 may have a distributed architecture, where various components are situated remotely from one another, but can be accessed by the processor 51. The software in memory 55 can include one or more software programs, each of which includes an ordered listing of executable instructions for implementing logical functions and/or artificial intelligence software. In the example of FIG. 8, the software in the memory system 55 includes a suitable operating system (O/S) 56 and program(s) 57. The operating system 56 essentially controls the execution of input/output interface 52 and other element functions, and provides scheduling, input-output control, file and data management, memory management, and communication control and related services. The operating system 56 may be, for example, LINUX (or another UNIX variant), Android (available from Google), Symbian OS, Microsoft Windows CE, Microsoft Windows 7 Mobile, iOS (available from Apple, Inc.), webOS (available from Hewlett Packard), Blackberry OS (Available from Research in Motion), and the like. The programs 57 may include various applications, add-ons, etc. configured to provide end user functionality of the system 100. In a typical example, one or more of the programs 57 may comprise instructions for controlling the functions of temperature regulators 22A, 22B, 22C, 22D, air moving devices 41A, 41B, environmental control devices 45A, 45B, sensors 47A, 47B, 47C, 47D, 47E, 47F, 47G, 47H, 47I, 47J, etc., of the system 100.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

The controller 50 may also include a main memory, such as a random access memory (RAM) or other dynamic storage device (e.g., dynamic RAM (DRAM), static RAM (SRAM), and synchronous DRAM (SDRAM)), coupled to the bus for storing information and instructions to be executed by the processor 51. In addition, the main memory may be used for storing temporary variables or other intermediate information during the execution of instructions by the processor 51. The controller 50 may further include a read only memory (ROM) or other static storage device (e.g., programmable ROM (PROM), erasable PROM (EPROM), and electrically erasable PROM (EEPROM)) coupled to the bus for storing static information and instructions for the processor 51.

In preferred embodiments, the system 100 may comprise a controller 50 which may be configured to control heat generated by one or more temperature regulators 22A, 22B, 22C, 22D, of the system 100. In some embodiments, a controller 50 may be configured to control heat generated by one or more temperature regulators 22A, 22B, 22C, 22D, based on user 201 input received via an I/O interface 52. In further embodiments, a controller 50 may be configured to control heat generated by one or more temperature regulators 22A, 22B, 22C, 22D, based on user 201 input received via a network interface 53 from an electronic device 250A, 250B, that is in communication with the network interface 53. In further embodiments, a controller 50 may be configured to control heat generated by one or more temperature regulators 22A, 22B, 22C, 22D, using temperature data received from one or more sensors 47A, 47B, 47C, 47D, 47E, 47F, 47G, 47H, 47I, 47J. As an example, a user 201 may provide input to the controller 50 indicating that the temperature of a first temperature regulator 22A that is positioned below the user's 201 head or torso should be 72 degrees and a second temperature regulator 22B that is positioned below the user's 201 legs or feet should be 74 degrees, and the controller 50 may use temperature data from the temperature regulators 22A, 22B, and/or one or more sensors 47A, 47B, 47C, 47D, 47E, 47F, 47G, 47H, 47I, 47J, to control the temperature regulators 22A, 22B, by increasing, maintaining, and/or decreasing the heat generated by the temperature regulators 22A, 22B, to maintain the desired temperatures. Optionally, the controller 50 may comprise a time keeping function which may be used to enable the controller 50 to control the temperature regulators 22A, 22B, by increasing, maintaining, and/or decreasing the heat generated by the temperature regulators 22A, 22B, to maintain the desired temperatures according to one or more time, day, date, etc., schedules.

In preferred embodiments, the system 100 may comprise a controller 50 which may be configured to control the amount or speed of air moved through the plurality of pillows 31 by one or more air moving devices 41A, 41B, of the system 100. In some embodiments, a controller 50 may be configured to control the amount or speed of air moved by one or more air moving devices 41A, 41B, based on user 201 input received via an I/O interface 52. In further embodiments, a controller 50 may be configured to control the amount or speed of air moved by one or more air moving devices 41A, 41B, based on user 201 input received via a network interface 53 from an electronic device 250A, 250B, that is in communication with the network interface 53. As an example, a user 201 may provide input to the controller 50 indicating that the amount or speed of air moved through the plurality of pillows 31 by one or more air moving devices 41A, 41B, should be changed from no air moved or a relatively low amount of air moved to a relatively high amount of air moved, and the controller 50 may increase the amount of electricity provided to the one or more air moving devices 41A, 41B, to control the one or more air moving devices 41A, 41B, to move the desired amount of air. Optionally, the controller 50 may comprise a time keeping function which may be used to enable the controller 50 to control the one or more air moving devices 41A, 41B, by increasing, maintaining, and/or decreasing the amount of air moved by the one or more air moving devices 41A, 41B, according to one or more time, day, date, etc., schedules. Optionally, the controller 50 may comprise sequential and/or artificial intelligence computing software which may be used to enable the controller 50 to control the one or more air moving devices 41A, 41B, by increasing, maintaining, and/or decreasing the amount of air moved by the one or more air moving devices 41A, 41B, in order to more rapidly and/or accurately control the various temperatures within frame 11.

In some embodiments, the system 100 may comprise a controller 50 which may be configured to control the temperature (heating or cooling) of air moved through the support grid 21, and therefore the temperature of air moved through the plurality of pillows 31, by controlling an environmental control device 45A, 45B, of the system 100. In some embodiments, a controller 50 may be configured to control an environmental control device 45A, 45B, based on user 201 input received via an I/O interface 52. In further embodiments, a controller 50 may be configured to control an environmental control device 45A, 45B, based on user 201 input received via a network interface 53 from an electronic device 250A, 250B, that is in communication with the network interface 53. As an example, a user 201 may provide input to the controller 50 indicating that the temperature of air moved through the support grid 21, and therefore the temperature of air moved through the plurality of pillows 31, should be 68 degrees, and the controller 50 may use temperature data from one or more sensors 47A, 47B, 47C, 47D, 47E, 47F, 47G, 47H, 47I, 47J, to control the environmental control device 45A, 45B, by increasing, maintaining, and/or decreasing the heating or cooling generated by the environmental control device 45A, 45B, to maintain the desired temperature. Optionally, the controller 50 may comprise a time keeping function which may be used to enable the controller 50 to control the environmental control device 45 by increasing, maintaining, and/or decreasing the heating or cooling generated by environmental control device 45 to maintain the desired temperature according to one or more time, day, date, etc., schedules.

In some embodiments, the system 100 may comprise a controller 50 which may be configured to control the humidity of air moved through the support grid 21, and therefore the humidity of air moved through the plurality of pillows 31, by controlling an environmental control device 45A, 45B, of the system 100. In some embodiments, a controller 50 may be configured to control an environmental control device 45A, 45B, based on user 201 input received via an I/O interface 52. In further embodiments, a controller 50 may be configured to control an environmental control device 45A, 45B, based on user 201 input received via a network interface 53 from an electronic device 250A, 250B, that is in communication with the network interface 53. As an example, a user 201 may provide input to the controller 50 indicating that the humidity of air moved through the support grid 21, and therefore the humidity of air moved through the plurality of pillows 31, should be approximately 55 percent relative humidity, and the controller 50 may control the environmental control device 45A, 45B, to increase, maintain, and/or decrease the humidifying or dehumidifying of the environmental control device 45A, 45B, to maintain the humidity. Optionally, the controller 50 may comprise a time keeping function which may be used to enable the controller 50 to control the environmental control device 45A, 45B, by increasing, maintaining, and/or decreasing the humidifying or dehumidifying of the environmental control device 45A, 45B, to maintain the desired humidity according to one or more time, day, date, etc., schedules.

While some exemplary shapes and sizes have been provided for elements of the system 100, it should be understood to one of ordinary skill in the art that a frame 11, frame cavity 12, pillows 31, optional support units 23, 23A, 23B, 23C, 23D, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the system 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A three dimensional mattress system for supporting a user comprising:

a rigid frame;

a frame cavity, wherein the frame cavity is open at its highest elevation;

a plurality of pillows contained within the frame cavity, wherein at least a portion of the plurality of pillows is coverless, wherein at least a portion of the pillows in the plurality of pillows are not physically attached to one another and are substantially independent of one another such that they can move freely within the frame cavity, and wherein the plurality of pillows forms a first body support area for supporting a first portion of the user; and a support unit, wherein the support unit forms a second body support area for supporting a second portion of the user.

2. The system of claim 1, wherein a portion of the frame cavity is formed by the support unit.

3. The system of claim 1, wherein the support unit is disposed in the frame cavity.

4. The system of claim 1, wherein the system comprises a length dimension (OL), wherein the frame cavity comprises a length dimension (CL), and wherein the CL is between 20 and 40 percent of OL.

5. The system of claim 1, further comprising a temperature regulator.

6. The system of claim 1, further comprising a support grid positioned below the plurality of pillows.

7. The system of claim 6, further comprising two or more air spaces below the support grid and two or more sensors.

8. The system of claim 1, further comprising a controller.

9. The system of claim 8, further comprising a sensor that is configured to supply environmental data to the controller.

10. The system of claim 8, wherein the controller comprises a network interface, and wherein the controller is configured to receive user input via an electronic device that is in electronic communication with the network interface.

11. The system of claim 1, wherein each pillow of the plurality of pillows comprises a width dimension of between 0.5 and 36.0 inches, wherein each pillow of the plurality of pillows comprises a length dimension of between 0.5 and 36.0 inches, and wherein each pillow of the plurality of pillows comprises a height dimension of between 0.5 and 12.0 inches.

12. The system of claim 1, wherein each pillow of the plurality of pillows comprises a generally rectangular prism shape.

13. The system of claim 1, wherein the plurality of pillows comprises greater than 20 pillows.

14. The system of claim 1, wherein the plurality of pillows is entirely coverless.

15. The system of claim 1, further comprising an air moving device configured to move air through at least a portion of the plurality of pillows.

16. The system of claim 15, further comprising an environmental control device configured to control at least one of the temperature, humidity, or air gas concentration of air moved through the plurality of pillows.

17. The system of claim 16, wherein the environmental control device is configured to control the humidity of air moved through the plurality of pillows.

18. The system of claim 15, further comprising an air filter configured to filter air moved by the air moving device.

19. The system of claim 15, wherein the air moving device is at least partially positioned within the frame cavity.

* * * * *